United States Patent [19]

Greenleaf

[11] Patent Number: 4,627,195

[45] Date of Patent: Dec. 9, 1986

[54] COMPUTER CONTROLLER OPTICAL SURFACING (CCOS) LAP PRESSURE CONTROL SYSTEM

[75] Inventor: Allen H. Greenleaf, Pownal, Me.

[73] Assignee: The United States of America as represented by the Secretary of the Air Force, Washington, D.C.

[21] Appl. No.: 777,141

[22] Filed: Sep. 18, 1985

[51] Int. Cl.[4] ..... B24B 7/00

[52] U.S. Cl. ..... 51/119; 51/109 R; 51/209 R

[58] Field of Search ..... 51/71, 109 R, 119, 125, 51/209 R, 209 DL, 283 R, 330, DIG. 6; 29/81 R, 81 J, 81 G; 125/5

[56] References Cited

U.S. PATENT DOCUMENTS

| | | | |
|---|---|---|---|
| 843,624 | 2/1907 | Peirce . | |
| 1,293,334 | 2/1919 | Challet . | |
| 2,423,118 | 7/1947 | Ramsay | 51/161 |
| 3,517,466 | 6/1970 | Bouvier | 51/358 |
| 3,699,721 | 10/1972 | Beasley | 51/209 DL |

FOREIGN PATENT DOCUMENTS

| | | | |
|---|---|---|---|
| 663242 | 5/1963 | Canada | 51/209 |
| 59360 | 9/1982 | European Pat. Off. | 51/109 R |
| 2659438 | 7/1978 | Fed. Rep. of Germany | 51/209 R |
| 2929479 | 2/1981 | Fed. Rep. of Germany | 51/119 |
| 127657 | 8/1982 | Japan | 51/283 R |
| 422571 | 9/1974 | U.S.S.R. | 51/209 R |

*Primary Examiner*—Robert P. Olszewski

*Attorney, Agent, or Firm*—William G. Auton; Donald J. Singer

[57] ABSTRACT

A rotary lapping system and process is disclosed for producing a controlled pressure gradient, including positive and negative lift, when lapping a workpiece coated with an abrasive slurry liquid with a plurality of grinding pads mounted beneath a rotating lap substrate. To obtain positive and negative lift, the grinding pads are tilted with respectively a positive and negative angle of attack, which hydrodynamically reacts with the abrasive slurry liquid to produce the desired lift. The controlled pressure gradient is further varied by decentering the rotation of lap substrate.

3 Claims, 3 Drawing Figures

COMPUTER CONTROLLER OPTICAL SURFACING (CCOS) LAP PRESSURE CONTROL SYSTEM

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to the lap grinding of surfaces and specifically to a rotary lapping system which applies a controllable pressure gradient to workpieces.

Future generations of orbiting telescopes used for astronomy, information collection and transmission, and power transmission will require very large segmented mirrors. The telescope designs will necessarily make use of highly aspheric mirrors in order to keep the telescope dimensions and weight to a minimum and very thin glass sections which will limit the usable grinding and polishing pressures.

Traditional optical fabrication techniques and rotary lapping systems will be impractical for these mirrors. A review of optical surfacing techniques indicates that two-thirds of the manufacturing time is spent polishing out subsurface damage from grinding. The lightweight optical elements and mirrors of orbiting telescopes will be extremely thin (e.g., 3 mm) and aspheric with changing surface curvature.

The need to process large sections of thin aspheric sections of optical systems in a rapid and efficient manner, was recognized in two inventions of Mr. Roger Kenneth Lee. The first invention is entitled "Very High Speed Lap With Negative Lift Effect", U.S. Ser. No. 06/720,936 filed Apr. 8, 1985, the disclosure of which is incorporated by reference. In this first invention, Mr. Lee disclosed a particular mounting of the grinding pads which caused the leading edge pads to possess a negative angle of attack when rotated in an abrasive slurry liquid. The hydrodynamic effect of the negative angle of attack in the abrasive slurry liquid while adjacent to a workpiece resulted in a negative lift or suction between the grinding pads and the workpiece. The use of negative lift in rotary lap grinding allows a generation of strong cutting forces for grinding and polishing with little or no downward pressure on the workpiece. This is ideal for grinding and polishing thin section of optical mirrors.

The second invention of Mr. Lee is entitled "Very High Speed Lap With Positive Lift Effect", U.S. Ser. No. 06/720,937 filed Apr. 8, 1985, the disclosure of which is incorporated by reference. In this second invention, Mr. Lee disclosed a particular mounting of the grinding pads which caused the leading edge pads to possess a positive angle of attack when rotated in an abrasive slurry liquid. The hydrodynamic effect of the positive angle of attack in the abrasive slurry liquid while adjacent to a workpiece resulted in a positive lift on the grinding pads. The use of positive lift in rotary lap grinding helps prevent the grinding tool from digging into the surface of a workpiece slurry very high speed lap grinding.

The lapping systems, described above, depend upon the hydrodynamic forces generated during rotation in an abrasive slurry liquid to produce the desired positive and negative angles of attack in grinding pads which are flexibly mounted to a grinding tool and have a neutral angle of attack. Since the positive and negative angles of attack are produced by the configuration of the flexible mounting around the grinding pads, the positive lift and negative lift grinding tools in the prior art are separate tools: one providing positive lift through the act of rotating in an abrasive slurry liquid, and the other providing negative lift.

The need to rapidly and efficiently process large sections of optical systems suggests that highly automated methods are needed. Additionally, the grinding and polishing of aspheric surfaces efficiently entails applying a varying pressure gradient to the workpiece. In view of the foregoing discussion, it is apparent that there currently exists the need for a single rotary lapping system that can apply changing pressure gradients on workpieces, including positive and negative lift, to efficiently grind and polish thin, aspheric workpieces. The present invention is directed towards satisfying that need.

SUMMARY OF THE INVENTION

The present invention is a rotary lapping system which applies a controllable gradient to workpieces. The controllable gradient is a product of two features of the invention. The first feature entails vaiable tipping of the grinding pads which allows a user to select between a positive and negative angle of attack as well as the degree of the angle of attack of the grinding pads. Each grinding pad is mounted beneath a circular lap substrate, and has an upwardly extending stem which extends through the substrate into a notch in a rotating control plate, where adjustable control springs fix each stem to produce the desired tipping in each grinding pad. Different settings in the control springs result in different attitudes in the guiding pads below.

The second feature entails an adjustable decentering of the lap substrate to bias the average operating pressure in the tipping moment applied to the grinding pads. This decentering gives the tipping moment applied to the pads a sinusoidally variation around the circumference of the lap, which produces the equivalent of the required pressure gradient.

It is a principal object of the invention to present a rotary lapping system capable of grinding and polishing thin, aspheric workpieces in a rapid and efficient manner.

It is another object of the present invention to minimize subsurface damage when grinding thin workpieces.

It is another object of the present invention to present a rotary lapping system with variable tipping in the grinding pads allowing a selection of angles of attack to produce positive or negative lift when rotating in an abrasive slurry liquid.

It is another object of the present invention to provide an adjustable decentering in the rotation to bias the average operating pressure in the tipping moment applied to the pads.

These together with other objects features and advantages of the invention will become more readily apparent from the following detailed description when taken in conjunction with the accompanying drawings wherein like elements are given like reference numerals throughout.

DETAILED DESCRIPTION OF THE PREFERRED EMBODIMENT

The present invention is a rotary lapping system which applies an adjustable pressure gradient to workpieces. This adjustable pressure gradient is partially the result of a phenomenon in lap grinding in which the angle of attack of the grinding pads in an abrasive slurry liquid has the hydrodynamic effect of producing a positive or a negative lift on the grinding pads.

Figure 1:
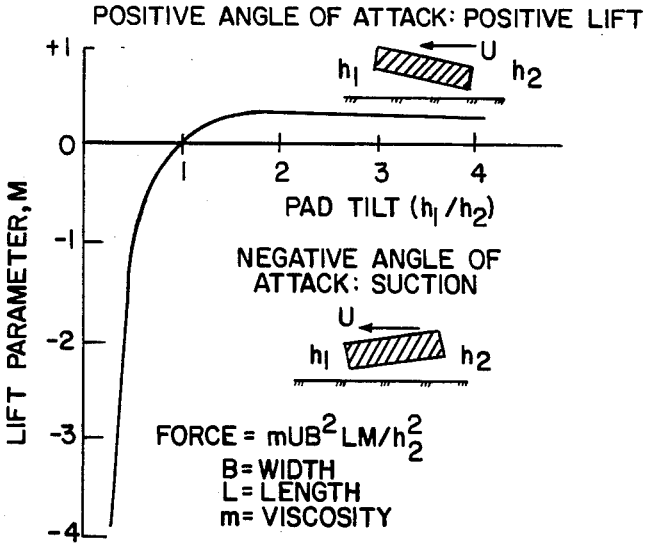
FIG. 1 is a chart depicting the performance of a tilting pad bearing.

FIG. 1 is a chart depicting the performance of a tilting pad bearing. The chart was originally disclosed in the above-referenced disclosures of Mr. Roger Kenneth Lee. As indicated by the chart, when a grinding pad is rotated in an abrasive slurry liquid with a positive angle of attack over a workpiece, a positive lift results which causes the pad to hydroplane over the workpiece. Positive lift is useful since it helps prevent the grinding pad from digging into the workpiece.

When the grinding pad is rotated with a negative angle of attack over a workpiece in an abrasive slurry liquid, the hydrodynamic action results in a negative lift, or suction between the pad and the workpiece. Negative lift allows the grinding pad to produce strong cutting pressures with little or no downward pressure on the workpiece. This is particularly useful for the thin glass sections that are planned for use in future optical systems.

The above-referenced disclosures of Mr. Lee describe two separate rotary grinding tools: one capable of producing positive lift in its leading edge grinding pads, and the other capable of producing only negative lift. The rotary lapping system of the present invention includes grinding pads which have adjustable angles of attack which are capable of both positive and negative lift.

Figure 2:
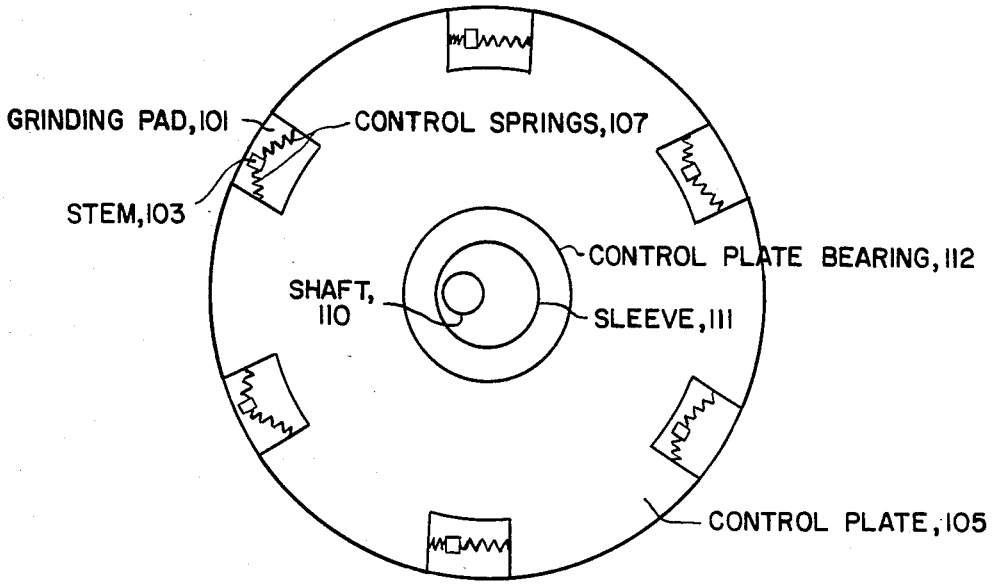
FIG. 2 is a plan view of a preferred embodiment for a rotary lapping mechanism of the present invention.
Figure 3:
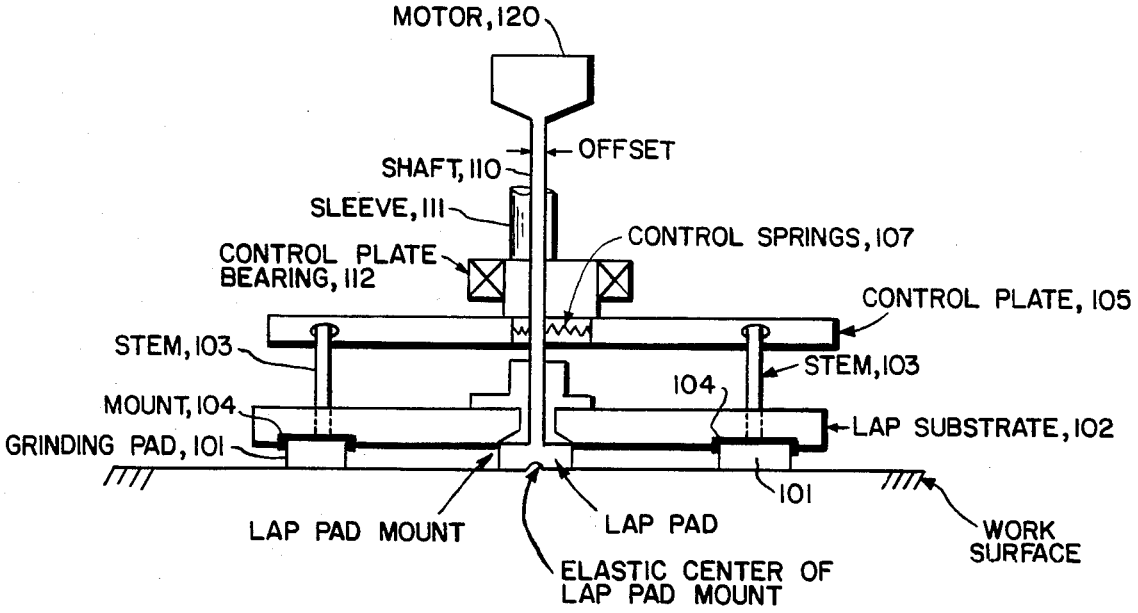
FIG. 3 is a sectional view taken along the lines 2—2 of FIG. 2.

FIG. 2 is a plan view of a preferred embodiment for a rotary lapping mechanism of the present invention; and FIG. 3 is a sectional view taken along the lines 2—2 of FIG. 2.

As shown in FIGS. 2 and 3, each grinding pad 101 is mounted beneath a circular substrate 102, with an upwardly extending stem 103 which is mounted in a notch of a control plate 105 by adjustable control springs 107. The adjustable control springs 107 apply a force on the stems 123 in a direction which is tangential to the circular control plate. By positioning the stems 103, the controlled tipping is applied to the grinding pads. This controlled tipping is tangential to the circular substrate and is manifested as either a positive or negative angle of attack in the grinding pads 101, depending upon the setting of the stems 103.

The grinding pads of FIG. 3 are mounted beneath the circular lap substrate 102 using a stiff rubber mount which helps prevent the friction of grinding from altering the angle of attack of the pad. Additionally, the elastic center of each rubber mount lies in the grinding surface of the grinding pad 101 so that tangential force on the grinding pad 101 produces no tipping moment. The mount 104 is not described in detail since the mounts for grinding pads are well known in the art. For example, U.S. Pat. Nos. 3,517,466 issued to J. Bouvier on June 30, 1970, and 3,699,721 issued to G. Beasley on Oct. 24, 1972, both of which are incorporated herein by reference, show the use of rubber pads in constructing lap grinding tools. It should be emphasized that the rubber mount mentioned above is just an example of a mounting means which holds the grinding pads in place on the circular lap substrate while allowing controlled tilting of the pad by the stem to adjust its angle of attack. The mounting means could encompass such variations as a plurality of hinges which fix the grinding pads to the circular lap substrate, while allowing controlled tilting, but the preferred embodiment incorporates the individual rubber mounts discussed above.

The control plate 105 is mounted, and rotates with, the lap substrate 102 on a shaft 110 which passes through a control plate bearing 112 to a motor 120 which provides the rotation. The shaft 110 can be decentered in the control plate bearing, 112 to give the tipping moment applied to the grinding pads a sinusoidally varying form around the circumference of the lap, which produces the equivalent of the required pressure gradient. Note that the actual tipping of each grinding pad is produced by tilting its stem 103 which projects perpendicularly upwards from each pad. The adjustable control springs 107 in the control plate 105 tilt the stems 103 which in turn tilt the grinding pad 101 in a direction which is tangential to the circular control plate 105.

The tilt of the grinding pad is, tangential to the path of rotation when the pads follow a concentric path of rotation about the shaft. During eccentric rotation, the shaft 110 is decentered with respect to the control plate and the tilt of the grinding pad is no longer constantly tangential to the path of rotation. The result is that the tipping moment sinusoidally varies in form around the circumference of the lap. Note that the eccentric rotation does not vary tilt of the grinding path with respect to the work surface. Eccentric rotation simply varies the pad's tilt with respect to whether the tilt is aligned directly with the velocity vector of the pad. When the tilt is tangential to a concentric path of rotation, the tilt is always aligned with the velocity vector that the pad is actually traveling. As Mr. Roger Kenneth Lee noted in the above-cited patent applications, the positive and negative tilt of the grinding pad reacts hydrodynamically in an abrasive slurry liquid to respectively produce a positive and negative lift. Eccentric rotation varies the pads tilt with respect to its forward velocity vector and therefore varies the positive and negative lift produced by the pad.

The control plate bearing 112 is fixed within the control plate to allow it to be rotated eccentrically about the shaft. The result is that the shaft is decentered with respect to the control plate 105, as shown in FIG. 2. The decentering mechanism is not disclosed herein in detail, since rotary systems having such decentering are available commercially, and are well known to those of ordinary skill in the art. For example, U.S. Pat. Nos. 1,293,334 issued to E. Challet on Feb. 4, 1979, and 2,423,118 issued to M. Ramsay on July 1, 1977, the disclosure of which are incorporated herein by reference, both disclose adjustable rotating, eccentrically mounted lap grinding machines. Similar to the above-referenced patents, the embodiment of the invention depicted in FIG. 3 provides a means for decentering the rotation of the lap substrate 102.

In operation, control of material removed by rotary lapping is accomplished in two ways: the amount of time at a given location, and the pressure gradient across the diameter of the lap. Two methods of controlling the pressure gradient have been described above. The first entails the selection and degree of positive and negative lift produced by the grinding pads by adjusting their angle of attack. Negative lift is suitable for thin workpieces since strong cutting pressures can be produced with little or no downward pressure on the workpiece. Positive lift is suitable for aspheric workpieces (with a changing surface curvature) since it causes the grinding pads to hydroplane over the surface ot the workpiece, and thus helps prevent the grinding pad from digging into the workpiece.

The second method of adjusting the pressure gradient, described above, entailed the adjustable decentering of the rotation of the circular lap substrate. This gives the tipping moment of the pads a sinusoidally varying form around the circumference of the lap.

The rotary lapping system of the present invention is intended to enhance the application of highly automated methods to rotary lapping, as discussed by the inventor Allen H. Greenleaf in his article entitled "Computer-Controlled Optical Surfacing" published in SPIE Volume 228 p. 41 (1980), the disclosure of which is incorporated herein by reference. While the above-reference article does not completely disclose the invention, it relates to the type of equipment and system in which the invention might be best used.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. A rotary lapping system capable of generating a controlled pressure gradient including positive and negative lift when lapping a workpiece which is coated with an abrasive slurry liquid, said rotary lapping system comprising:

a rotating means;

a shaft connected to and being rotated by said rotating means;

a lap substrate connected to and rotated by said shaft;

a plurality of adjustable grinding pads mounted beneath and being rotated by said lap substrate, and adjustable grinding pads generating positive lift when rotated in said abrasive slurry liquid with a positive angle of attack, said adjustable grinding paths generating a negative lift when rotated in said abrasive slurry liquid with a negative angle of attack, and wherein each of said plurality of grinding pads comprises a grinding pad mounted beneath said lap substrate, said grinding pad having a grinding surface on its bottom which is presented to the workpiece, and an upwardly extending stem on its top which passes through the lap substrate to the adjusting means, said stem tilting the grinding pad at positive and negative angles of attack when tilted by said adjusting means;

a means for mounting each of said plurality of adjustable grinding pads to said lap substrate;

a control plate fixed on the shaft above the lap substrate and rotating with the lap substrate, said control plate having a plurality of notches into which each stem from said plurality of adjustable grinding pads is inserted; and a plurality of adjustable control springs, each mounted in one of the notches of the control plate and holding the stem of an adjustable grinding pad in an adjustable position to tilt the adjustable grinding pad into the variable angles of attack including: positive angles of attack, a neutral angle of attack, and negative angles of attack.

2. A rotary system, as defined in claim 1, wherein said mounting means comprises:

a plurality of flexible pads, each having its upper surface bonded beneath the lap substrate, and its lower surface bonded to the top of one of said plurality of adjustable grinding pads, each of said flexible pads having its elastic center positioned in the grinding surface of its adjustable grinding pad.

3. A rotary system, as defined in claim 1, including a means of decentering any rotation of the lap substrate, said decentering means giving tipping moments applied to the adjustable grinding pads a sinusoidal variation.

* * * * *